US006132527A

United States Patent [19]

Hessell et al.

[11] Patent Number: 6,132,527

[45] **Date of Patent: *Oct. 17, 2000**

[54] NICKEL ALLOY FOR TURBINE ENGINE COMPONENTS

[75] Inventors: Steven J Hessell, Derby; Wayne Voice, Nottingham; Allister W James, Derby; Sarah A Blackham, Derby; Colin J Small, Derby; Michael R Winstone, Aldershot, all of United Kingdom

[73] Assignee: Rolls-Royce plc, London, United Kingdom

[ * ] Notice: This patent is subject to a terminal disclaimer.

[21] Appl. No.: 09/206,965

[22] Filed: Dec. 8, 1998

Related U.S. Application Data

[63] Continuation of application No. 08/834,335, Apr. 16, 1997, Pat. No. 5,897,718.

[30] Foreign Application Priority Data

Apr. 24, 1996 [GB] United Kingdom ..... 9608617

[51] Int. Cl.[7] ..... C22C 19/05

[52] U.S. Cl. ..... 148/410; 148/428; 420/448

[58] Field of Search ..... 148/410, 428; 420/443, 448

[56] References Cited

U.S. PATENT DOCUMENTS 5,124,123 6/1992 Henry ..... 420/448

5,897,718 4/1999 Hessell et al. ..... 148/410

*Primary Examiner*—George Wyszomierski

*Attorney, Agent, or Firm*—W. Warren Taltavull; Farkas & Manelli PLLC

[57] ABSTRACT

A new nickel base superalloy suitable for compressor or turbine discs of gas turbine engines with fatigue crack propagation resistance equal to Waspaloy, tensile strength higher than Waspaloy and higher operating temperature than Waspaloy or UDIMET 720 family of alloys. The nickel base superalloy has a preferred composition by weight % of 14.0–19.0% cobalt, 14.35–15.15 Chromium, 4.25–5.25 Molybdenum, 1.35–2.15 tantalum, 3.45–4.15 titanium, 2.85–3.15 aluminium, 0.01–0.025 boron, 0.012–0.033 carbon, 0.05–0.07 zirconium, 0.5–1.0 hafnium, up to 1.0 rhenium, up to 2.0 tungsten, less than 0.5 niobium, up to 0.1 yttrium, up to 0.1 vanadium, up to 1.0 iron, up to 0.2 silicon, up to 0.15 manganese and balance nickel plus incidental impurities.

3 Claims, 3 Drawing Sheets

NICKEL ALLOY FOR TURBINE ENGINE COMPONENTS

This is a continuation of Ser. No. 08/834,335 filed Apr. 16, 1997, now U.S. Pat. No. 5,897,718.

THE FIELD OF THE INVENTION

This invention is concerned with new nickel base superalloys, and with wrought and heat-treated products made from them e.g. compressor and turbine discs. The turbine disc, which may be up to one meter in diameter, is a critical part of a gas turbine e.g. a turbine. Failure of such a component in operation is usually catastrophic.

BACKGROUND OF THE INVENTION

For more than thirty years there has been a continuing need for improved alloys to enable engine components such as turbine discs to be operated under more rigorous conditions. The nickel base superalloy known as Waspaloy was introduced in 1967, and is still used today despite its limitations of strength and maximum temperature of use. UDIMET 720, an alloy with improved strength, was introduced in 1986 (UDIMET is a Registered Trade Mark of Special Metals Corporation). However, UDIMET 720 was found to be unstable (with respect to the formation of deleterious Topologically Close Packed (TCP) phases) and was superseded in 1990 by powder processed UDIMET 720Li (low interstitial), an alloy with reduced chromium, carbon and boron. Improvements in cast and wrought (C+W) processing led to the introduction of C+W UDIMET 720Li in 1994. Cast and wrought UDIMET 720Li exhibits near equivalent properties to those of the powder variant. Although UDIMET 720Li has adequate strength, its resistance to fatigue crack propagation is somewhat lower than Waspaloy, and its maximum operating temperature is limited to approximately 650° C.

There is a continuing need to define an alloy composition, microstructure, heat treatment and process route to meet the increasing demands of future civil and military turbine discs. It is an object of the present invention to meet that need. Nickel base superalloys are so complex, with generally about ten alloying components present, that optimisation of alloy composition is extremely difficult. Phase diagram modelling has been used extensively during the development of the invention to predict the component phases and their proportions.

SUMMARY OF THE INVENTION

The present invention provides a nickel base alloy comprising in weight percent 14.0% to 19.0% cobalt, 14.35% to 15.15% chromium, 4.25% to 5.25% molybdenum, 1.35% to 2.15% tantalum, 3.45% to 4.15% titanium, 2.85% to 3.15% aluminium, 0.01% to 0.025% boron, 0.012% to 0.033% carbon, 0.05% to 0.07% zirconium, 0.5% to 1.0% hafnium, up to 1.0% rhenium, up to 2.0% tungsten, less than 0.5% niobium, up to 0.1 yttrium, up to 0.1% vanadium, up to 1.0% iron, up to 0.2% silicon up to 0.15% manganese and the balance nickel plus incidental impurities.

DETAILED DESCRIPTION OF THE INVENTION

One alloy may comprise in weight percent 18.5% cobalt, 15% chromium, 5% molybdenum, 2% tantalum, 3.6% titanium, 3% aluminium, 0.075% hafnium, 0.015% boron, 0.06% zirconium, 0.027% carbon and the balance nickel plus incidental impurities.

Another alloy may comprise in weight percent 15% cobalt, 14.5% chromium, 4.5% molybdenum, 1.5% tantalum, 4% titanium, 3% aluminium, 0.015% boron, 0.06% zirconium, 0.027% carbon and the balance nickel plus incidental impurities.

A further alloy may comprise in weight percent 15% cobalt, 14.5% chromium, 4.5% molybdenum, 1.5% tantalum, 4% titanium, 3% aluminium, 0.75% hafnium, 0.015% boron, 0.06% zirconium, 0.027% carbon and the balance nickel plus incidental impurities.

The Ni level is often 40–60 wt %.

Preferred alloys should have the following characteristics

Fatigue crack propagation resistance approximately equal to that of Waspaloy. This key property is achieved without loss of overall property balance.

Tensile strength higher than Waspaloy, specifically an Ultimate Tensile Strength (UTS) of at least 1400 MPa at a temperature of 550° C.

Creep strain limited to not more than 0.1 Total Plastic Strain (TPS) in 40 hours at a temperature of 725° C. with an applied stress of 500 MPa.

A weight fraction of gamma prime phase at 725° C. of 45±2%. [Increasing the gamma prime volume fraction improves the tensile strength. Controlling the gamma prime weight fraction to these levels retains the balance between tensile strength and fatigue crack propagation resistance.]

A degree of instability and potential to form grain boundary carbides of the $M_6C$ and/or $M_{23}C_6$ types. [Our work leading up to this invention has indicated that less stable alloys exhibit greater resistance to fatigue crack propagation.]

Limited formation of Topologically Close Packed (TCP) phases. Preferably the proportion of TCP phases (in the wrought and heat treated product) is less than 7.0 wt % at a temperature of 725° C. [We have found that excessive precipitation of sigma and mu phases degrade the creep properties of these superalloys.]

The solvus of a TCP phase is less, preferably at least 40° C. less, than the solvus of the $M_6C$ or $M_{23}C_6$ phases.

A higher operating temperature than Waspaloy or any of the UDIMET 720 family of alloys.

The following Table I recites the compositions of three preferred alloys according to the invention, together with the compositions of four alloys from the prior art. It can be seen that the preferred alloys of the present invention are characterised by the inclusion of tantalum, and by the combination of ranges of chromium, molybdenum, titanium and aluminium.

Various components are identified as having particular effects on the chemistry/mechanical property relationships of the alloy:

Cobalt (within the 15 to 18.5 wt % range) has no significant effect on the tensile or creep strength of the alloys. The presence of 15 wt % cobalt generates a minimum Stacking Fault Energy (SFE) which promotes planar deformation and potentially improved fatigue crack propagation resistance.

Chromium levels have been raised to improve fatigue crack propagation resistance without excessive formation of TCP phases.

Molybdenum has a beneficial effect on tensile strength and ductility at high temperatures, but levels have been controlled to balance the high chromium with respect to TCP phase formation.

Tantalum increases tensile strength, but segregates to form very stable tantalum carbide (MC carbide). The tantalum concentration has been controlled to allow the MC carbide to breakdown and promote the formation of grain boundary carbides.

Titanium controls with aluminium the weight fraction gamma prime, and has the greatest effect on the gamma prime solvus. The titanium content has been increased to balance the reduced tantalum levels in order to maintain tensile strength, whilst also controlling the gamma prime weight fraction and TCP phase formation.

Aluminium has been balanced with respect to titanium in order to control the gamma prime weight fraction. The aluminium concentration has also been limited in order to reduce the propensity for TCP phase formation.

Boron has been reduced to levels which are beneficial to creep, fatigue crack propagation resistance and tensile strength.

Carbon has been maintained at levels to promote hot ductility and high temperature creep resistance.

Zirconium has been increased to 0.06 wt %, as it has a beneficial effect on stress rupture and creep resistance.

Hafnium has been included at 0.75 wt % (in two of the three alloys). The addition of hafnium improves all properties.

Rhenium has a strong beneficial effect on creep resistance and might usefully be included.

TABLE I

SUPERALLOY COMPOSITION COMPARISON

| Alloy | Co | Cr | Mo | Ta | Ti | Al | Hf | W | Nb | B | Zr | C |
|---|---|---|---|---|---|---|---|---|---|---|---|---|
| 1 | 18.5 | 15 | 5 | 2 | 3.6 | 3 | 0.75 | — | — | 0.015 | 0.06 | 0.027 |
| 2 | 15 | 14.5 | 4.5 | 1.5 | 4 | 3 | — | — | — | 0.015 | 0.06 | 0.027 |
| 3 | 15 | 14.5 | 4.5 | 1.5 | 4 | 3 | 0.75 | — | — | 0.015 | 0.06 | 0.027 |
| Waspaloy | 13.5 | 19.5 | 4.25 | — | 3.05 | 1.4 | — | — | — | 0.0065 | 0.05 | 0.06 |
| U720Li | 15 | 16 | 3 | — | 5 | 2.5 | — | 1.25 | — | 0.015 | 0.035 | 0.015 |
| Rene 88 | 13 | 16 | 4 | — | 3.7 | 2.1 | — | 4 | 0.75 | 0.02 | 0.04 | 0.04 |
| N18 | 15.7 | 11.5 | 6.5 | — | 4.35 | 4.35 | 0.5 | — | — | 0.015 | 0.03 | 0.015 |

All values are expressed in weight percent. Balance nickel.

In order to take advantage of the potential of the new alloys of this invention, the following processing steps are preferred for manufacture of an article: production of billet utilising either powder metallurgy or cast & wrought techniques;

working the billet by either an isothermal or hot die route, followed by either partial or full solution treatment, controlled cooling and ageing.

1. Billet

Billet can be produced by either powder or cast & wrought routes.

a) Powder billet is produced using standard powder techniques, involving consolidation by routes such as HIP+extrude or HIP+cog. Consolidation takes place at a temperature below the gamma prime solvus of the alloy.

b) Cast+wrought billet is produced via a triple melt method, followed by a conversion route defined to give a suitably homogeneous product.

Step 1(a) is preferred for larger forgings, with cast & wrought potentially more suitable for smaller items.

The option exists to precondition the billet prior to forging, by soaking at a temperature up to gamma prime solvus minus 100° C., for times between 2 and 24 hours.

2. Forging

Forging the billet near to shape under either isothermal or hot die conditions, eg: at a billet temperature up to gamma prime solvus minus 60° C., at a strain rate between $1\times10^{-4}$ and $1\times10^{-2}$ $s^{-1}$; or at a temperature up to gamma prime solvus minus 120° C. at a strain rate between $1\times10^{-2}$ and $5\times10^{-1}$ $s^{-1}$.

3. Heat Treatment

Partially or fully solution treating the item at a temperature in the range: gamma prime solvus minus 40° C. up to gamma prime solvus plus 20° C., for times between 0.5 and 8 hours. Cooling from solution temperature at a rate suitable to avoid cracking, whilst maintaining the alloy tensile response, eg: between 0.2 and 10° C./s. Finally, ageing at temperatures between 650 and 900° C. for between 10 and 30 hours.

A relatively coarse grain size is associated with good fatigue crack growth resistance. An aim of the overall processing conditions of the current invention is therefore to achieve a fairly coarse grain size in the wrought and heat treated product, preferably within the range 6 to 45 μm. A uniform grain size in the range 25 to 35 μm is particularly preferred, but a non-uniform grain size, including a duplex structure may be satisfactory.

The following Table II provides information about the gamma prime and sigma phases in the alloys of the present invention, the prior alloy UDIMET 720Li being included for comparison. It can be noted that the weight percent and the solvus of the sigma phase in alloys 2 and 3 have been reduced below the levels for UDIMET 720Li.

TABLE II

| Alloy | gamma prime weight percent (725° C.) | gamma prime solvus (° C.) | weight percent sigma (725° C.) | sigma solvus (° C.) |
|---|---|---|---|---|
| 1 | 44.4 | 1165 | 6.87 | 888 |
| 2 & 3 | 45.7 | 1157 | 4.12 | 827 |
| Udimet 720Li | 43.7 | 1163 | 4.67 | 832 |

The following Table III reports on certain mechanical properties, creep and ultimate tensile strength, of the alloys of the invention compared to some known alloys.

TABLE III

Superalloy Mechanical Properties

| Alloy | Time to 0.1% TPS (hours) 500 MPa/725° C. | UTS (MPa) typical 600° C. |
|---|---|---|
| 1 | 35–40 | 1500+ |
| 2 & 3 | 40–45 | 1550+ |
| Waspaloy | <2 | 1143 |
| UDIMET 720Li | 15 | 1510 |

BRIEF DESCRIPTION OF THE DRAWINGS

Reference is directed to the accompanying FIGS. 1, 2 and 3, each of which is a phase diagram model prediction for alloy 2.

The following key applies to these figures.

Figure 1:
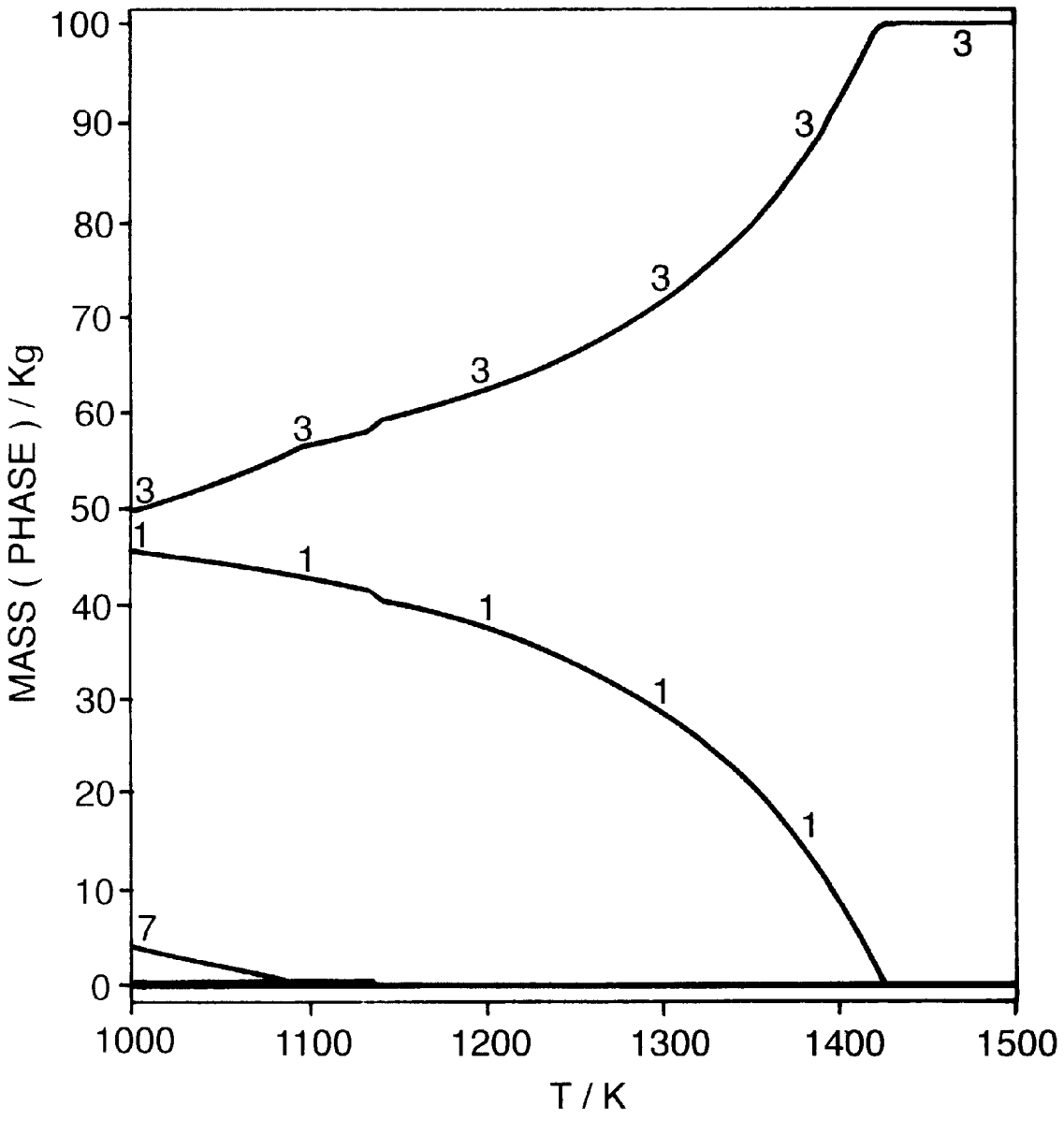
FIG. 1 shows phase mass from 0–100 wt % against temperature.
Figure 2:
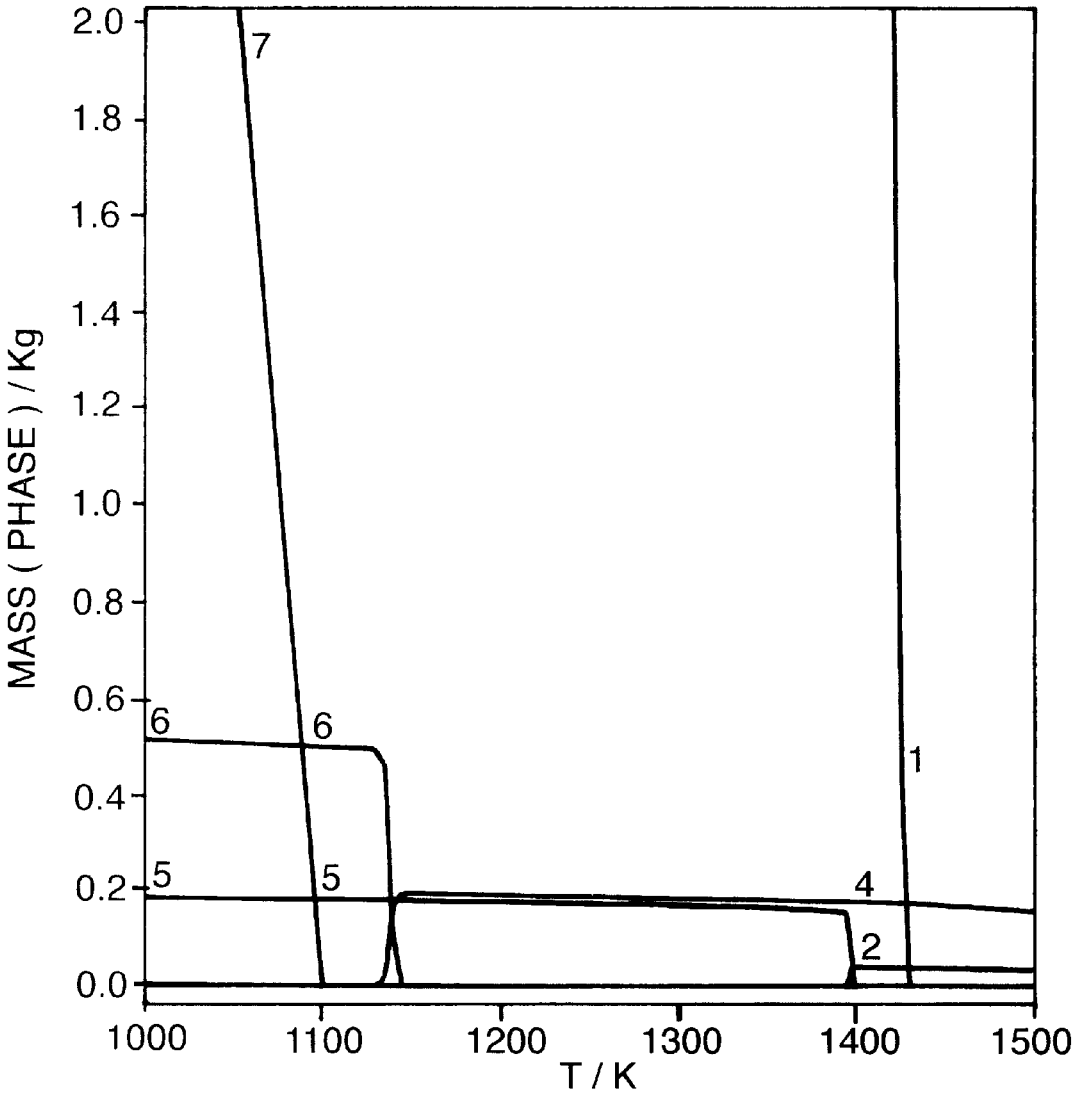
FIG. 2 is an enlarged version of part of FIG. 1 and shows phase mass from 0–2 wt % against temperature.
Figure 3:
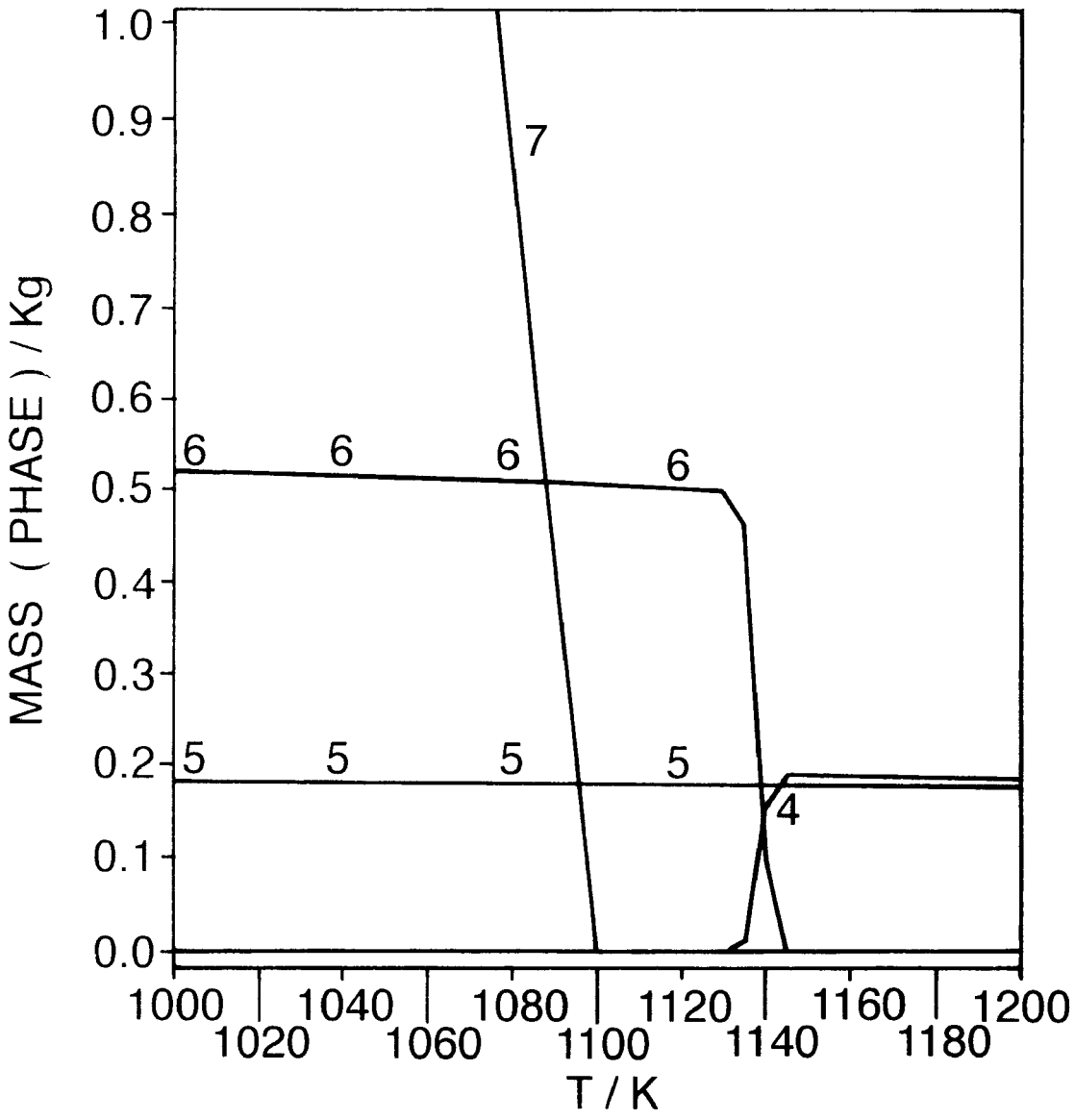
FIG. 3 is an enlarged version of part of FIGS. 1 and 2 and shows phase mass from 0–1 wt %, and temperature from 1000–1200 K.

1. Gamma prime
2. $MB_2$
3. Gamma (nickel)
4. MC carbide
5. $M_3B_2$
6. $M_{23}C_6$
7. Sigma The sigma phase (7) has a solvus at 1100K (827° C.) The $M_{23}C_6$ phase (6) has a solvus around 1170K (897° C). An ageing heat treatment lying between these temperatures (ie: applicable heat treatment window) encourages formation of a desired $M_{23}C_6$ phase.

It should be noted that there is no heat treatment 'window' for alloy 1. This alloy exhibits a sigma solvus temperature which is above that of the $M_{23}C_6$ solvus.

It is preferred that there is less than 0.5% niobium added to these alloys, more preferably there is no niobium added to these alloys.

It is well know that the fatigue crack propagation resistance and the creep resistance of the majority of nickel base superalloys may be improved by increasing the grain size. Nickel base superalloys are composed of two principal phases, a gamma matrix and an ordered strengthening gamma prime phase ($Ni_3Al/Ti$). At the gamma prime solvus temperature of the alloy, the gamma prime phase is taken completely into solution in the gamma matrix. The gamma prime phase exists as two principal sizes, the primary gamma prime and the secondary gamma prime. The primary gamma prime is the larger of the two and is located on the grain boundaries. The primary gamma prime is retained throughout the manufacturing process to prevent the migration of the grain boundaries and hence to control grain size. If the primary gamma prime volume fraction is reduced the grain size is increased, even at temperatures below the gamma prime solvus temperature. The secondary gamma prime is precipitated uniformly throughout the gamma matrix on cooling during heat treatment processes.

Heat treatment at temperatures greater than the gamma prime solvus temperature, super solvus heat treatment, usually results in non-uniform grain growth, and thus it is difficult to generate reproducible structures using supersolvus heat treatments. Heat treatments at a temperature near, but less than, the gamma prime solvus temperature may be used to generate controlled and reproducible uniform grain growth.

The alloys of the present invention have a fine grain microstructure/size and it has been found that they inherently have good fatigue crack propagation resistance. The creep resistance and fatigue crack propagation resistance of the alloys of the present invention may be improved by increasing the grain size. Thus the alloys of the present invention do not require a supersolvus heat treatment, or other heat treatments, to generate a coarser grained microstructure in order to obtain good fatigue crack propagation resistance. Thus it can be seen that the alloys of the present invention make it possible to dispense with the expensive super solvus, or other heat treatments. The fine grains are normally 6–12 $\mu$m, medium grains are 12–30 $\mu$m and coarse grains are greater than 30 $\mu$m.

We claim:

1. A nickel base alloy consisting essentially of in weight percent 15% to 19.0% cobalt, 14.35% to 15.15% chromium, 4.25% to 5.25% molybdenum, 1.35% to 2.15% tantalum, 3.45% to 4.15% titanium, 2.85% to 3.15% aluminium, 0.01% to 0.025% boron, 0.012% to 0.033% carbon, 0.05% to 0.07% zirconium, 0 to 1.0% hafnium, up to 1.0% rhenium, up to 2.0% tungsten, essentially no niobium, up to 0.1% yttrium, up to 0.1% vanadium, up to 1.0% iron, up to 0.2% silicon up to 0.15% manganese and the balance nickel plus incidental impurities.

2. An alloy as claimed in claim 1 wherein the alloy comprises in weight percent 15% cobalt, 14.5% chromium, 4.5% molybdenum, 1.5% tantalum, 4% titanium, 3% aluminium, 0.015% boron, 0.06% zirconium, 0.027% carbon and the balance nickel plus incidental impurities.

3. An alloy as claimed in claim 1 wherein the alloy comprises in weight percent 15% cobalt, 14.5% chromium, 4.5% molybdenum, 1.5% tantalum, 4% titanium, 3% aluminium, 0.75% hafnium, 0.015% boron, 0.06% zirconium, 0.027%, carbon and the balance nickel plus incidental impurities.

* * * * *